United States Patent [19]

Schellenberg

[11] 3,961,958

[45] June 8, 1976

[54] PROCESS FOR FIXING PHOTOGRAPHIC MATERIAL

[75] Inventor: Matthias Schellenberg, Marly, Switzerland

[73] Assignee: Ciba-Geigy AG, Basel, Switzerland

[22] Filed: Oct. 9, 1974

[21] Appl. No.: 513,449

[30] Foreign Application Priority Data

Oct. 18, 1973 Switzerland ..... 14756/73

[52] U.S. Cl. ..... 96/61 R

[51] Int. Cl.[2] ..... G03C 5/38

[58] Field of Search ..... 96/61 R, 109, 61 M

[56] References Cited

UNITED STATES PATENTS

| | | | |
|---|---|---|---|
| 3,347,675 | 10/1967 | Henn et al. | 96/61 |
| 3,520,688 | 7/1970 | Jargiello | 96/61 R |
| 3,573,915 | 4/1971 | Luciani | 96/66.5 |
| 3,615,510 | 10/1971 | Yudelson et al. | 96/61 R |
| 3,712,818 | 1/1973 | Nittel et al. | 96/61 R |
| 3,732,104 | 5/1973 | Vandenabeele et al. | 96/109 |

OTHER PUBLICATIONS

Photographic Chemistry, Glafkides, vol. F p. 332.

*Primary Examiner*—Mary F. Kelley
*Attorney, Agent, or Firm*—Joseph G. Kolodny; Edward McC. Roberts; Prabodh I. Almaula

[57] ABSTRACT

The present invention relates to a process for fixing silver iodide containing photographic material with a fixing bath. The bath contains, in addition to a compound capable of forming soluble silver complexes, at least one organic solvent, preferably N-methylpyrrolidone. The organic solvent increases the speed of dissolution of the silver iodide.

6 Claims, No Drawings

PROCESS FOR FIXING PHOTOGRAPHIC MATERIAL

When processing photographic material, the fixing step serves to remove, from the emulsion, the light-sensitive silver halide which, after developing a latent image, has not been converted into metallic silver. The fixing agents used are substances which convert the silver halides into readily soluble complex compounds. These complexes diffuse easily out of the emulsion and can, at the end of the processsing sequence, be removed practically completely by soaking.

In principle, it is possible to use for the fixing process all compounds which are able to convert silver halides into readily soluble complexes, such as, for example, alkali metal bromides and iodides, alkali metal or ammonium cyanide or thiocyanate, thiourea, alkali metal thiosulphate or ammonium thiosulphate. Cyanides are very good and fast-acting fixing agents but are only used reluctantly, because of their extreme toxicity. In most cases, alkali metal salts or ammonium salts of thiosulphuric acid are used as fixing agents and as a rule one or more salts of sulphurous acid are added to them in order to stabilize the baths.

The silver halide-dissolving action of fixing agents depends on various factors, such as, for example, the concentration of complex-forming ions, the temperature, the pH value and the content of silver, which has already been bound as a complex, in the solution. In the case of the thiosulphates it has also been found that, for example, the dissolution time passes through a minimum at certain concentrations of the complex-forming anion. It is also known that the cation bonded to the thiosulphate ion exerts an important influence. Thus, for example, the fixing action of ammonium thiosulphate is greatest, and decreases noticeably in the sequence sodium thiosulphate-potassium thiosulphate.

The nature of the silver halide to be dissolved also plays an important role in the speed and completeness of fixing. Thus silver chloride, which is comparatively readily soluble, can be fixed rapidly and completely, whilst the rate of fixing is already substantially less for silver bromide. Because of its low solubility, silver iodide is the most difficult, and slowest, to fix.

Where the speed of the fixing process is of importance in photographic processes, it is therefore desirable as far as possible to avoid the use or subsequent formation of silver iodide. However, for various reasons this is not always possible.

It is the object of the present invention to increase the speed of fixing of silver iodide in the customary fixing baths, above all those which contain ammonium thiosulphate as the fixing agent. It has been found that the speed of dissolution of silver iodide in fixing baths can be increased substantially if solvents having certain properties are added to these baths.

Accordingly, the subject of the invention is a process for fixing photographic material, containing silver iodide, with an aqueous fixing bath which contains at least one compound capable of forming soluble silver complexes, preferably a thiosulphate. According to the invention, this fixing bath contains at least one of the following solvents: N-methyl-pyrrolidone, tetramethylurea, ε-caprolactam, phosphoric acid tris-dimethylamide ($O{=}P[N(CH_2)_2]_3$), N-methylmorpholine, glycol monomethyl ether, dimethylsulphone, dimethylsulphoxide, acetonitrile or dimethylformamide.

The present process is suitable for all photographic materials containing silver halide wherein the silver halide consists to a significant part of silver iodide. It is possible to fix by this method both black-and-white materials and colour photography materials, for example chromogen materials or silver dye bleach materials.

Amongst the fixing agents, such as alkali metal or ammonium cyanides, thiocyanates or thiosulphates, the latter, namely potassium, sodium and especially ammonium thiosulphate, are preferred. The fixing baths can also contain the customary additives, such as sodium sulphite and sodium metabisulphite.

A distinctly detectable effect is achieved even with only 10 g of solvent, especially N-methylpyrrolidone, in 1 liter of fixing bath, and can be increased with increasing amount of solvent. Particularly favourable results are achieved in some cases with 100 to 200 g of solvent per liter of fixing bath. A content exceeding 400 g is generally less advantageous. These comments in general apply when 1 liter of fixing bath contains 100 to 400 grams of compound, for example ammonium thiosulphate, which forms a silver complex.

The processing steps which precede the fixing and which may follow the fixing can be carried out in the usual manner which is in itself known. It is in most cases advisable to soak the material before, and especially after, the treatment with the fixing bath.

Whilst it is known from prior publications that photographic processing methods can, in various stages, be accelerated by adding solvents, the newly found effect according to the present invention is not suggested by any of these publications. Thus it is known, for example, from DT-AS 1,285,312 that solvents without atoms which form hydrogen bridges, such as dimethylformamide, dimethylsulphoxide, acetonitrile or tetrahydrofurane, can accelerate the photographic developing step. However, this patent specification contains no reference to any use and effect in the fixing process.

It is known from DT-OS 2,126,416 that polyethylene glycols of molecular weight above 400 have an accelerating action on the fixing process. For the same compounds, DT-OS 2,116,256 has disclosed an improvement of the ability electrolytically to regenerate spent fixing solutions.

Equally, Japanese Pat. Publication No. 72/25,384 mentions the addition of morpholine, pyrrolidine, piperidine, furane or tetrahydrofurane as an accelerating additive to developer solutions.

Finally, DT-OS 1,572,151 has disclosed that an addition of dimethylsulphoxide or of compounds which contain at least one hydroxyl group can extend the use range of fixing solutions to extremely high or low temperatures and in particular also permits the production of liquid made-up forms which will keep. However, it is this very publication which mentions that the clearing time of such fixing preparations is lengthened, that is to say the speed of fixing is lowered.

It must therefore be described as surprising, especially in view of the last-mentioned DT-OS, that the addition of one of the solvents mentioned, for example N-methylpyrrolidone, exerts an accelerating action on the fixing process if the photographic emulsions contain the silver halide predominantly in the form of silver iodide.

The speed of the fixing process is normally determined as a so-called clearing time, that is to say an unexposed photographic material which contains silver halide is treated under standardised conditions with the fixing solution which is to be measured and the time after which the optical turbidity caused by the disperse silver halide disappears, and the material has become transparent, is determined.

EXAMPLE 1

A panchromatic black-and-white photographic film of high sensitivity (for example IlfordHP4) was dipped for 1 minute into 0.1 molar potassium iodide solution in order to convert the silver halide to silver iodide and was then soaked for 10 minutes and dried. 5 $cm^2$ pieces of this material were fixed in fixing baths of a composition shown below, at 25°C under constant agitation of the bath, and in each case the clearing times were measured.

| | Fixing baths: | |
|---|---|---|
| (a) | Ammonium thiosulphate | 200 g |
| | Sodium sulphite | 70 g |
| | Sodium metabisulphite | 10 g |
| | $MgSO_4.7H_2O$ | 5 g |
| | Water to make up to | 1000 ml |
| (b) | Composition as for a), with the addition of 10 ml of N-methylpyrrolidone | |
| (c) | Composition as for a), with the addition of 40 ml of N-methylpyrrolidone | |
| (d) | Composition as for a), with the addition of 100 ml of N-methylpyrrolidone. | |

Testing the clearing times in the manner indicated gave the following values:

TABLE I

| Fixing bath | (a) | (b) | (c) | (d) |
|---|---|---|---|---|
| Clearing time, seconds | 105 | 93 | 82 | 39 |

EXAMPLE 2

Instead of the highly sensitive black-and-white film, a transparent silver dye bleach copying material which contained, in three of the total of seven layers, respectively a cyan, a magenta and a yellow azo dyestuff together with silver bromide/iodide, was processed in the manner indicated in Example 1, the solvents listed in Table II being added to the fixing bath (a) in the concentration shown. The point in time at which the last turbidity of the lowest layer of the emulsion, detectable from the rear of the material, disappeared, was determined as the clearing time end point.

TABLE II

| Solvent | Clearing time in seconds at 25°C | | | | |
|---|---|---|---|---|---|
| | 0% by volume | 1% by volume | 2% by volume | 5% by volume | 10% by volume |
| N-Methyl-pyrrolidone | 427 | 383 | 377 | 328 | 170 |

TABLE II-continued

| Solvent | Clearing time in seconds at 25°C | | | | |
|---|---|---|---|---|---|
| | 0% by volume | 1% by volume | 2% by volume | 5% by volume | 10% by volume |
| Phosphoric acid tris dimethyl-amide | 427 | 394 | 388 | 281 | 152 |
| Tetramethyl-urea | 427 | 380 | 310 | 239 | 147 |

EXAMPLE 3

The instructions of Example 1 were followed using the same fixing bath, which however contained one of the solvents listed in Table III, in the indicated concentrations, in place of N-methylpyrrolidone.

TABLE III

| Solvent | Clearing times in seconds at 25°C | | | |
|---|---|---|---|---|
| | 0 g/l | 1 g/l | 5 g/l | 10 g/l |
| Tetramethylurea | 105 | | | 32 |
| Phosphoric acid tris-dimethylamide | 105 | 97 | 48 | 39 |
| N-Methylmorpholine | 105 | 78 | 72 | 64 |
| Dimethylformamide | 105 | 83 | 74 | 64 |
| Glycol monomethyl ether | 105 | 88 | 79 | 82 |
| Dimethylsulphone | 105 | 77 | — | 75 |
| Dimethylsulphoxide | 105 | 75 | 72 | 66 |
| E-Caprolactam | 105 | 103 | 49 | 40 |
| Acetonitrile | 105 | 97 | 83 | — |

What is claimed is:

1. Process for fixing imagewise exposed and developed photographic material, containing silver iodide, with an aqueous fixing bath which contains at least one compound capable of forming soluble silver complexes and selected from the group consisting of thiocyanates and thiosulphates, which process comprises employing a fixing bath that contains at least one of the following solvents: N-methylpyrrolidone, ε-caprolactam, tetramethylurea, phosphoric acid trisdimethylamide, N-methylmorpholine, dimethylformamide, glycol monomethyl ether, dimethylsulphone, dimethylsulphoxide, acetonitrile.

2. Process according to claim 1, which comprises using N-methylpyrrolidone as the solvent.

3. Process according to claim 1, which comprises using ε-caprolactam as the solvent.

4. Process according to claim 1 which comprises using a fixing bath the solvent content of which lies in the range of 10 to 200 grams per liter of fixing bath.

5. Process according to claim 4, which comprises using a fixing bath the content of silver complex-forming compound of which lies in the range of 100 to 400 grams per liter of fixing bath.

6. Process according to claim 1 which comprises using ammonium thiosulphate as the silver complex-forming compound.

* * * * *